United States Patent [19]

Spurling

[11] Patent Number: 4,884,614

[45] Date of Patent: Dec. 5, 1989

[54] SAFETY GATE

[76] Inventor: Charles A. Spurling, 7 Indian Path, North Grafton, Mass. 01536

[21] Appl. No.: 93,066

[22] Filed: Aug. 27, 1987

Related U.S. Application Data

[63] Continuation of Ser. No. 819,069, Jan. 15, 1986, abandoned.

[51] Int. Cl.[4] ..... E06B 11/02

[52] U.S. Cl. ..... 160/225; 160/216; 49/463; 49/394; 49/55; 292/207; 292/67

[58] Field of Search ..... 160/210, 212, 213, 214, 160/215, 225, 222, 211, 216, 160; 49/463, 465, 394, 55, 57; 292/207, 246, 247, 238, 63, 67, 68

[56] References Cited

U.S. PATENT DOCUMENTS

| | | | |
|---|---|---|---|
| 141,677 | 8/1873 | Tuttle | 160/225 X |
| 207,605 | 9/1878 | Jackson | 49/465 |
| 275,448 | 4/1883 | Wilcox | 49/465 X |
| 610,193 | 9/1898 | Motley | 160/211 |
| 1,097,485 | 5/1914 | Turine | 292/246 |
| 1,670,908 | 5/1928 | Smith | 292/238 X |
| 1,876,856 | 9/1932 | Clay | 292/238 X |
| 2,387,025 | 10/1945 | Hoffman | 160/225 |
| 2,574,807 | 11/1951 | Woodruff | 49/55 |
| 2,577,034 | 12/1951 | Quinlan | 160/225 X |
| 2,717,064 | 9/1955 | Hock | 49/394 |
| 3,654,982 | 4/1972 | Labelle | 160/213 X |
| 3,885,616 | 5/1975 | Berkowitz | 160/222 X |
| 4,363,351 | 12/1982 | Eriksen | 160/213 X |
| 4,486,042 | 12/1984 | Chee | 292/246 |
| 4,574,860 | 3/1986 | Weiss | 160/213 X |
| 4,677,791 | 7/1987 | Larson et al. | 160/215 X |
| 4,702,036 | 10/1987 | Johnson | 49/394 X |

FOREIGN PATENT DOCUMENTS

| | | | |
|---|---|---|---|
| 908306 | 10/1962 | United Kingdom | 160/222 |

*Primary Examiner*—Ramon O. Ramirez
*Assistant Examiner*—David M. Purol
*Attorney, Agent, or Firm*—Irving M. Kriegsman

[57] ABSTRACT

A safety gate which is adapted to be mounted on the sidewalls at the top or bottom of a stairway to prevent unwanted access thereto by a toddler or on the sidewalls of a door frame or other structure to prevent unwanted passage therethrough from either direction by a toddler includes a mounting rail which is adapted to be fixedly attached to one of the sidewalls, a locking post which is adapted to be fixedly attached to the other sidewall opposite to the mounting rail and a gate frame assembly which is adapted to be removably and pivotally mounted to one end to the mounting rail and secured at the other end, when desired, to the locking post. When the gate frame assembly is mounted on the mounting rail, the gate frame can be pivoted back and forth like a swinging door when restricted passage is not desired and then locked to the locking post when restricted passage is desired.

1 Claim, 3 Drawing Sheets

SAFETY GATE

This application is a continuation of application Ser. No. 819,069, filed Jan. 15, 1986, now abandoned.

BACKGROUND OF THE INVENTION

The present invention relates generally to safety gates and more particularly to a safety gate which can be mounted on the sidewalls at the top or bottom of a stairway to prevent unwanted access thereto by a toddler or mounted on the sidewalls of a door frame to prevent unwanted passage to or from a room by a toddler or mounted on other similar structure for a similar purpose.

Safety gates to prevent toddlers from acessing a stairway, either from the top or from the bottom, or for restricting passage by a toddler from one room to another are well known in the art and have been in common use now for many years.

One well known type of safety gate is made up of an expandable rectangularly shaped frame having rubber friction pads on each side edge. In setting the gate up for use the frame is placed between the walls at the location where passage is to be restricted. The frame is then expanded so that the friction pads push up against each one of the walls. The frame is then locked by some mechanism in its expanded position. Although this type of safety gate can be very easily set up where its use is intended, it has the basic problem that it is not very safe and secure after it has been put in place. In particular, it can be easily pushed over, knocked down or pushed aside by the toddler. Also, once it has been installed in place, it cannot be removed correctly without mechanically readjusting it to a contracted position, and this must be done each and every time. Consequently, this type of safety gate has not proven to be entirely satisfactory in terms of performance.

Another well known type of safety gate is made up of an expandable frame which is fixedly attached at one end to one sidewall by mounting brackets and screws and which is removably and temporarily secured by a hook and eye combination or other similar mechanism at the other end to an opposite sidewall. Normally, the frame is in a contracted position. When access is to be restricted, the frame is expanded so that the end of the frame not fixedly attached to a sidewall can be locked to the other sidewall by the securing mechanism. When access is not to be restricted, the frame is placed in a closed or non-expanded (i.e. contracted) position. The problems with this type of safety gate are that (1) the locking mechanism used to lock the gate to the opposite sidewall when the gate is in its expanded position is generally not entirely secure against toddler tampering and subsequent opening, (2) the gate cannot be easily removed from the sidewall on which it is fixedly mounted, if for any reason its use is not needed, desired or wanted at that location for any particular time period and (3) the arrangement for "opening" the gate to permit passage therethrough by an adult is somewhat cumbersome, especially if it is to be open and closed repeatedly, since it involves releasing the locking mechanism and then contracting the gate.

Accordingly, it is an object of this invention to provide a new and improved safety gate.

It is another object of this invention to provide a safety gate which can be mounted on a sidewall such that it can pivot back and forth like a swinging door with a full 90 swing in each direction.

It is a further object of this invention to provide a safety gate having a gate frame which can be easily removed by an adult from its mounting structure, when its use is not desired but not removed very easily by a toddler.

It is still a further object of this invention to provide a safety gate which cannot be easily unlocked by a toddler once it is locked in place.

It is yet still a further object of this invention to provide a safety gate which cannot be pushed over or easily unlocked by a toddler.

It is another object of this invention to provide a safety gate which can be easily manufactured, assembled and used.

SUMMARY OF THE INVENTION

A safety gate which is adapted to be mounted on the sidewalls at the top or bottom of a stairway to prevent unwanted access thereto by a toddler or on the sidewalls of a door frame to prevent unwatnted passage therethrough from either direction by a toddler or on other similar structure constructed according to the teachings of the present invention includes a mounting rail which is adapted to be fixedly attached to one of the sidewalls, a locking post which is adapted to be fixedly attached to the other sidewall and a removable gate frame assembly. The gate frame assembly includes an expandable generally rectangular gate frame having a top edge, a bottom edge and a pair of side edges, a mounting bar hingedly connected to one of the side edges of the gate frame and adapted to be removably and slidably mounted on the mounting rail, first latch means for preventing easy removal of the mounting bar from the mounting rail by a toddler once it is mounted thereon, a locking bar movably mounted on the gate frame near the other side edge and adapted to be selectively brought into locking engagement with a slot on the locking post so as to maintain the gate frame in a locked, closed position when so desired and second latch means mounted on the locking post and adapted to engage the locking bar when it is in engagement with the locking post so as to prevent easy disengagement of the locking bar from the locking post by a toddler. When the gate frame assembly is mounted on the mounting rail, the gate frame can be pivoted back and forth in both directions like a swinging door when passage through is not intended to be restricted.

The foregoing and other objects and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

Figure 1:
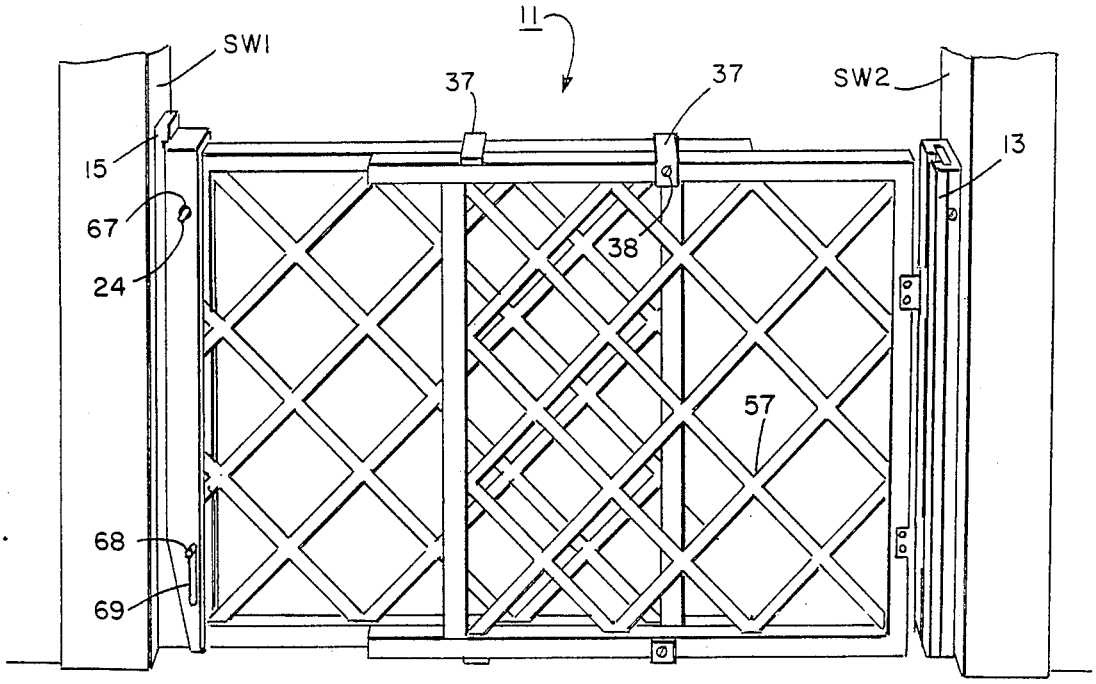
FIG. 1 is a perspective view of a safety gate constructed according to the teachings of the present invention, mounted for use on the side walls of a door frame with the gate in a closed and locked postion.
Figure 2:
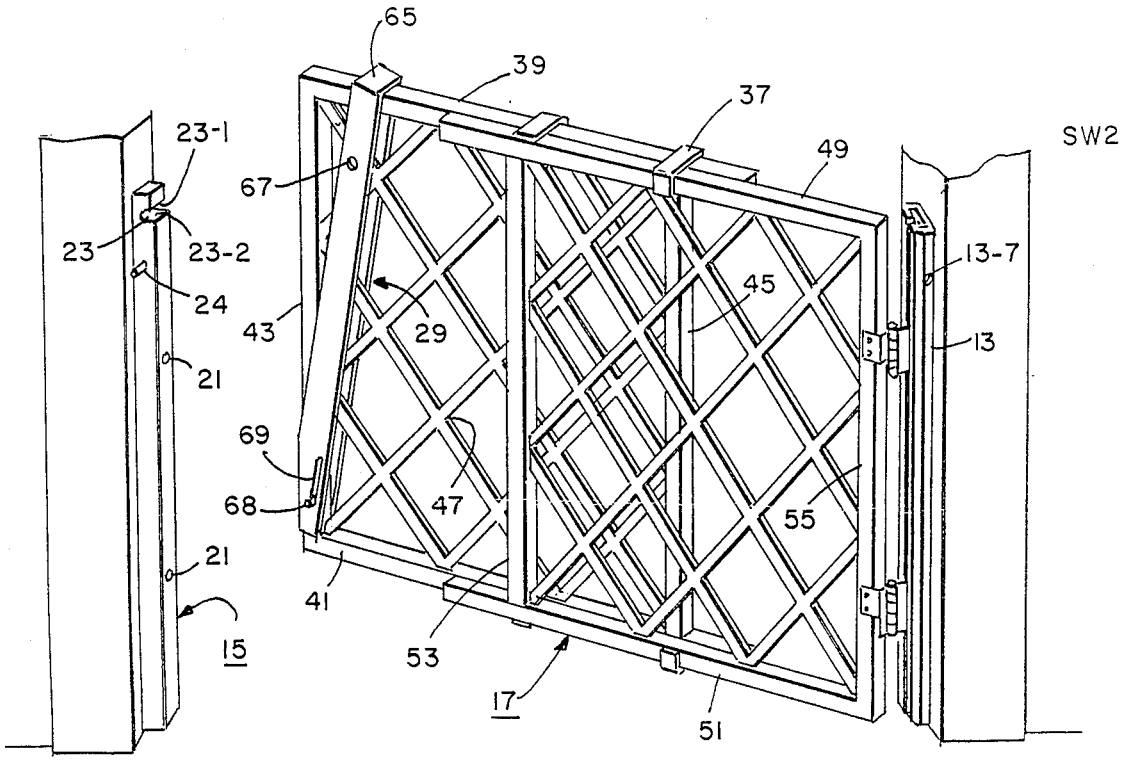
FIG. 2 is a perspective view of the safety gate shown in FIG. 1, but with the gate in an open position.

Referring now to the drawings, and first to FIGS. 1 and 2, there is shown a safety gate constructed according to the teachings of the present invention and mounted for use on a door frame of a doorway. The safety gate is identified generally by reference numeral 11 and the sides or side walls of the door frame are identified by reference characters SW1 and SW2. In FIG. 1, safety gate 11 is shown in a closed position, restricting passage through the doorway, while in FIG. 2 safety gate 11 is shown in a pivoted open position, allowing passage therethrough.

Safety gate 11 includes a mounting rail 13, a locking post 15 and a gate frame assembly 17.

Figure 4:
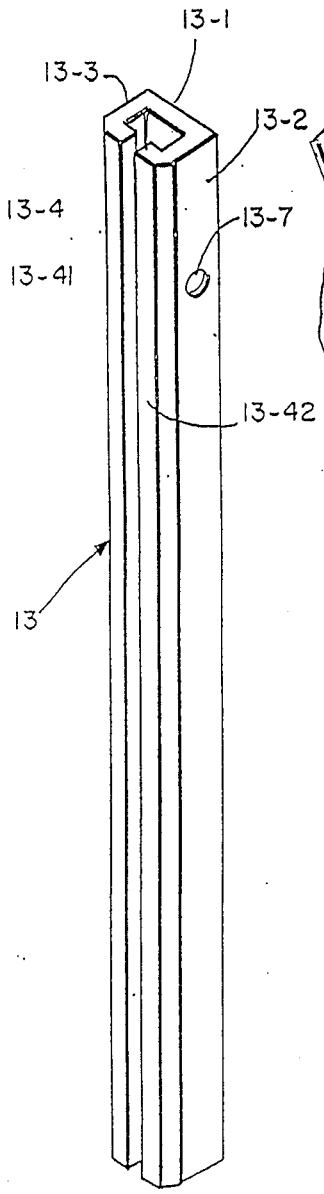
FIG. 4 is a perspective view of the locking bar in the safety gate shown in FIG. 1.
Figure 5:
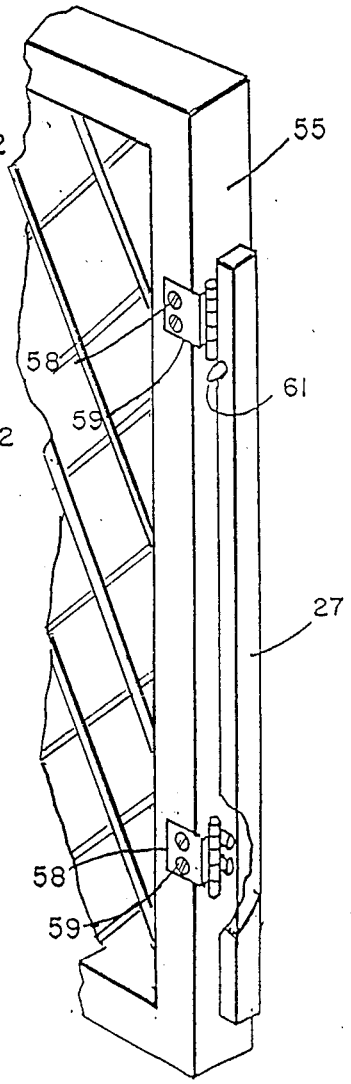
FIG. 5 is a perspective view of the mounting rail in the safety gate show in FIG. 1.
Figure 6:
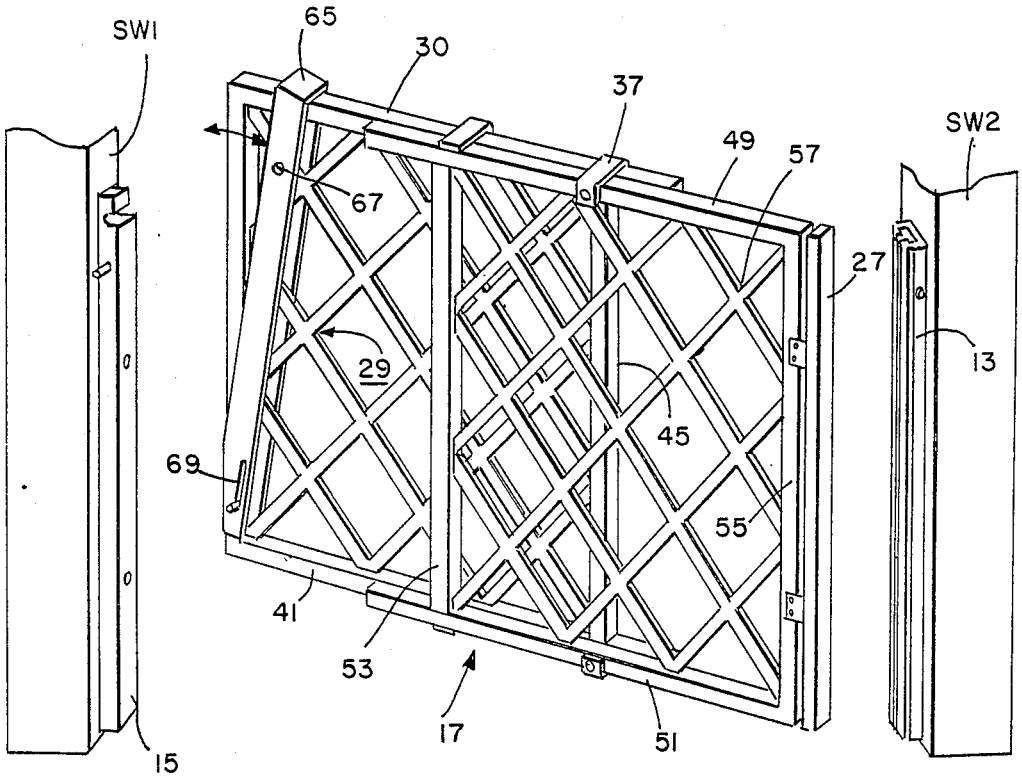
FIG. 6 is a perspective view of the gate frame assembly shown in FIG. 1, separate from the mounting structure.

Mounting rail 13, which is also shown separately in FIG. 4, is an elongated channel shaped member made of plastic, wood or other similar material. Mounting rail 13 includes a backwall 13-1, a pair of side walls 13-2 and 13-3 and a front wall 13-4. The front wall 13-4 is made up of two sections, 13-41 and 13-42, which are separated by an opening 13-6. A locking hole 13-7 is formed in side wall 13-2, preferably near the top. Mounting rail 13 is fixedly attached to sidewall SW1 by screws 14 which extend through countersunk mounting holes formed along the length of backwall 13-1 and into sidewall SW2.

Locking post 15 is an elongated, preferably solid member, is rectangular in cross-section, is made of plastic, wood or other similar material and is fixedly attached to sidewall SW2, opposite mounting rail 13, by screws 21 which extend through countersunk mounting holes formed along its length and into sidewall SW2. A locking slot 23, whose use will hereinafter be explained, is formed near the top of locking post 15 and a bullet latch 24, whose use will also hereinafter be explained, is imbedded in one side of locking post 15 near the top.

Gate frame assembly 17 includes a generally rectangular gate frame 25, a mounting bar 27, and a locking bar 29.

Gate frame 25 is expandable in length to accomodate different sized openings wherein passage is to be restricted and is made up of a generally rectangular left frame section 33 and a generally rectangular right frame section 35. The two frame sections are slidably movable relative to each other so that their overall length can be varied and are secured together at a desired overall length by brackets 37 and screws 38 or other suitable means, such as clamps. Left frame section 33 includes a top frame member 39, a bottom frame member 41 and a pair of side frame members 43 and 45, all of which may be made of plastic, wood or other similar material and a screen 47 which is made of plastic or wire or other similar material. Right frame section 35 includes a top frame member 49, a bottom frame member 51, a pair of side frame members 53 and 55 all of which may be made of plastic, wood or other similar material and a screen 57 which is made of plastic wire or other similar material.

Mounting bar 27, is an elongated solid member made of plastic, wood or other similar material and is sized and shaped in cross section so that it can be slidably inserted down into the channel in mounting rail 13 from the top but cannot be pulled out from the side through opening 13-6. Mounting bar 27 is mounted onto side frame member 55 of right frame section 35 so that it can be pivotally moved by hinges 58 which are attachd to bar 27 and frame member 55 by screws 59. A bullet latch 60 is imbedded in mounting bar 27 near the top. The tip of bullet latch 60 extends through locking hole 13-7 formed in mounting rail 13 when mounting bar 27 is fully inserted down inside the channel of mounting rail 13 and serves to prevent easy withdrawal upward of mounting bar 27 from mounting rail 13 by a toddler.

Figure 3:
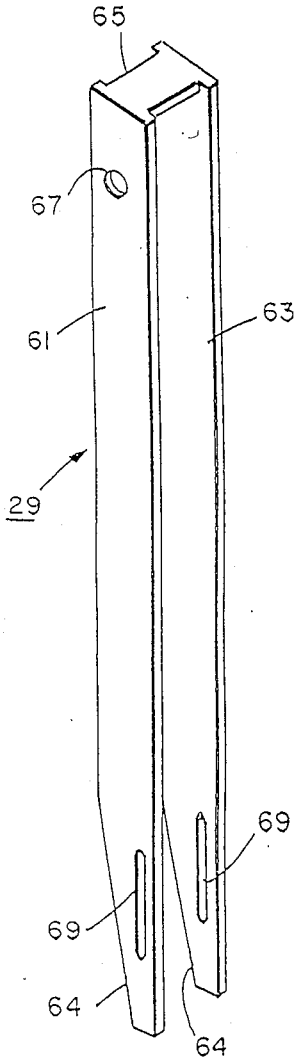
FIG. 3 is an enlarged view of the end of the gate frame shown in FIG. 1, containing the mounting rail.

Locking bar 29, which is also shown separately in FIG. 3 is a generally "U" shaped member and comprises a pair of elongated slats 61 and 63, which are made of wood, plastic or other suitable material. Slats 61 and 63 are each tapered inward near one end and joined together by a plate 65 at their nontapered end. A locking hole 67 is formed in slat 61 near its untapered end. An elongated longitudinally extending slot 69 is formed in each slat near its tapered end. Plate 65 is made of wood or plastic or other suitable material, is secured to the slats 61 and 63 by any suitable means (such as screws or nails or cement, not shown). Slats 61 and 63 and plate 65 may be formed as unitary structure instead of separate pieces. Locking bar 29 is pivotally and slidably mounted on left side frame member 43 of left frame section 33 by a bolt 68 which extends through the slots 69 formed in each slat 61 and 63 and through a circular hole (not shown) formed in left side frame member near the bottom and fastened to a nut (not shown).

In installing safety gate 11, mounting rail 13 and locking post 15 are first fixedly attached to their respective sidewalls SW1 and SW2. Gate frame assembly 17 is then mounted for use by simply inserting mounting bar 27 into the channel mounting rail 13 from the top. Mounting bar 27 is then lowered in place and once in place the head of bullet latch 60 will engage locking hole 13-7 in mounting rail 13. Safety gate 11 is then ready for use and gate frame 25 may then be pivoted back and forth about mounting bar 27 like a swinging door.

As is apparent, because of the slots 69, locking bar 27 can be raised or lowered relative to the frame 25 and pivoted from left to right.

When locking bar 29 is raised and angled upward to the right as shown in FIG. 2 slats 61 and 63 will not present an obstruction when gate frame 25 is swung back and forth past locking post 15, due to the tapered edge 64 on each slat 61 and 63. On the other hand, when locking bar 29 is in a lowered and vertical position as shown in FIG. 1, slats 61 and 63 will hit up against locking post 15 and will prevent the gate to swinging past locking post 15.

Gate frame 25 is locked in a closed position (as shown in FIG. 1) by raising locking bar 29 upward, as far as it will go, pivoting it to the left and then lowering it so that top plate 65 will drop and rest in slot 23 between the bottom wall 23-1 and the top wall 23-2. At the same time the head of bullet latch 24 will extend through locking hole 67 in slat 61. Once the head of bullet latch 24 engages locking hole 67, locking bar 29 cannot be easily raised by a toddler. Once locked in place, slats 61 and 63 of locking bar 29 are disposed on either side of locking post 15 and thus restrict movement of locking bar 29 (and hence the gate frame assembly) in either direction.

Gate frame 25 is unlocked from a locked position by simply raising locking bar 29 from slot 23 in locking post 15 and pivoting it back to the right (as shown in FIG. 2).

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A safety gate adapted to be removably and pivotally mounted on one of the sidewalls at the top or bottom of a stairway or one of the sidewalls of a door frame or other similar structure and selectively locked to an opposite sidewall to prevent unwanted passage therethrough, said safety gate comprising:

a. a mounting rail, b. means for fixedly attaching said mounting rail to one of the sidewalls, c. a locking post, d. means for fixedly attaching said locking post to the other sidewall, opposite to the mounting rail, e. a gate frame, said gate frame having a generally rectangular shape and including a top, a bottom and a pair of sides, f. a mounting bar hingedly attached to one side of said gate frame and slidably and removably mounted on said mounting rail such that said gate frame can be pivoted back and forth relative to said mounting rail like a swinging door when said mounting bar is mounted on said mounting rail and, when desired can be removed from said mounting rail, and g. locking means mounted on said gate frame near said other side for selectively locking said other side of gate frame to said locking post, said locking post having a slot and said locking means comprises a locking bar and has a portion adapted to be brought into engagement with said slot in said locking post, said locking bar comprising a generally U shaped member having a pair of elongated slats joined together by a plate, each of said slats including an elongated slot at a lower end thereof and having a pin means disposed therethrough into engagement with said gate frame such that said locking bars pivotally and slidably mounted on said gate frame, each slat preventing swinging movement of said gate frame in one direction when said locking bar is in engagement with said locking post.

* * * * *